US005123978A

United States Patent [19]

Balin et al.

[11] Patent Number: 5,123,978

[45] Date of Patent: Jun. 23, 1992

[54] CORROSION RESISTANT CHROMATE CONVERSION COATINGS FOR HEAT-TREATED ALUMINUM ALLOYS

[75] Inventors: Lionel J. Balin, Foster City; Wash Kostinko, Santa Cruz, both of Calif.

[73] Assignee: The United States of America as represented by the Secretary of the Navy, Washington, D.C.

[21] Appl. No.: 671,592

[22] Filed: Mar. 19, 1991

[51] Int. Cl.[5] ..... C23C 22/44

[52] U.S. Cl. ..... 148/247; 148/268

[58] Field of Search ..... 148/247, 268

[56] References Cited

U.S. PATENT DOCUMENTS 2,276,353 3/1942 Thompson .
2,507,956 5/1950 Bruno et al. .
2,851,385 9/1958 Spruance et al. .
3,752,707 8/1973 Newell et al. .
4,036,667 7/1977 Simon .
4,131,489 12/1978 Newhard, Jr. .
4,146,410 3/1979 Reinhold .
4,451,304 5/1984 Batiuk .
4,531,978 7/1985 Otrhalek et al. .

*Primary Examiner*—Sam Silverberg
*Attorney, Agent, or Firm*—Kenneth L. Warsh; Wayne O. Hadland

[57] ABSTRACT

An improved method of coating 7000 series aluminum alloys, which are difficult to coat uniformly, with a coating resistant to long term corrosion in a salt spray environment is disclosed. By using a chromate solution of very low pH and applying that solution first as a cleaner, followed by brush application to form the final coating, an extended resistance to corrosion at least 2 to 3 times the usual duration is achieved readily.

8 Claims, No Drawings

CORROSION RESISTANT CHROMATE CONVERSION COATINGS FOR HEAT-TREATED ALUMINUM ALLOYS

FIELD OF THE INVENTION

This invention pertains to chemical conversion coated heat treated aluminum alloys. More specifically this invention relates to a method of improving the corrosion resistance of chemical conversion coated heat-treated aluminum alloys.

BACKGROUND OF THE INVENTION

Because of mechanical considerations, it is not always possible to use the most corrosion resistant aluminum alloy for a specific application. The availability of coated alloys has gone a long way toward solving this problem. More specifically, chromate conversion coated aluminum alloys have long been used to improve aluminum alloys' corrosion resistance. In the prior art, the alloys were treated with a chromated deoxidizer to etch away the natural and heat-treat/oxide and then coated in the conversion process with a corrosion resistant coating.

The 7000 series aluminum alloys are aluminum/zinc-/magnesium alloy and aluminum/zinc/copper alloy systems. The 7075 high-strength aircraft alloy that contains aluminum, zinc, magnesium, and copper has been used for rocket motors. The 7075 alloy is heat-treated to avoid stress corrosion cracking, an extremely serious, very difficult to control mode of corrosion failure. The treatment is known as overaging (a longer heat treatment beyond that ordinarily utilized to obtain maximum strength) in which copper-containing components of the alloy are dispersed as secondary precipitates throughout the bulk of the alloy. The alloy produced is called 7075-T73 or 7175-T-7452, the latter specified for hand forgings of a somewhat higher-purity grade of 7075. Although stress corrosion cracking is significantly reduced by overaging, pitting corrosion is exacerbated. Thus, there is a need for an improved method or formula of chromate coating.

When coated aluminum alloys are manufactured for use in military applications for which high strength characteristics are a primary requirement, a stringent corrosion resistant test must be met whereby the finished alloy is subjected to a salt spray for a lengthy period of time. Prior to the present invention, it was extremely difficult to pass the salt spray requirement imposed by the military for aluminum alloy hardware. Most of the anti-corrosion, chromate conversion type coatings used on overaged heat treated 7000 series aluminum alloys have been very susceptible to localized salt spray corrosion, i.e. pitting.

The process of coating aluminum alloys actually is a chemical reaction involving two reactants: the chemical solution and the metal substrate. The nature of currently used alloys is such that the substrate is adverse to reacting uniformly with the solution. This is one of the main obstacles to overcome in achieving corrosion resistant alloys of this type.

U.S. Pat. No. 4,131,489 issued to Newhard, Jr. on Dec. 26, 1978 relates to a method of improving both corrosion resistance and paint adhesion of chromate conversion coatings on aluminum and alloys thereof (lines 3-6, 17-20 and 31-34 of col. 2). The conversion coating solution comprises chromate ion, phosphate ion and fluoride ion and during the coating process, the free fluoride ion content is maintained within the desired limits by adding fluoride in the form of hydrofluoric acid to the coating composition (lines 33-36 of col. 3). The salt spray test is governed by ASTM B-117, Standard Method of Salt Spray (Fog) Testing which applies to all corrosion testing referred to herein. The preparative method includes contacting the aluminum surfaces to be treated with the coating composition for a time and at a temperature sufficient to produce an effective coating (lines 34-37 of col. 4). As stated in lines 56-65 of col. 4, the conventional coating process includes the steps of rinsing the metal following each immersion step. This reference relates to the use of free fluoride, preferably in the form of hydrofluoric acid, in the chromate conversion coating composition for improving both the corrosion resistance and paint adhesion on aluminum alloy.

U.S. Pat. No. 4,451,304 issued to Batiuk on May 29, 1984 discloses a method of improving the corrosion resistance of chemical conversion coated aluminum, especially to meet the salt spray test requirements imposed by the military (lines 15-20 of col. 1 and lines 48-51 of col. 3). The method comprises the following steps sequentially: vapor degreasing, alkaline cleaning, rinsing with water, deoxidizing with a chromated or non-chromated deoxidizer, rinsing with water, exposing to a sodium nitrite solution, rinsing with water, chemical corrosion coating and finally drying the aluminum (lines 13-25 and 37-40 of col. 4). The preferred deoxidizer includes fluoride ion obtained from hydrofluoric acid or any suitable salt (lines 47-48 of col. 4). The chemical conversion coating solution may be Alodine 1200S TM (manufactured by Amchem Products, Inc.) which contains sodium fluoride (lines 11-13 and 24-25 of col. 5). This reference relates to the use of free fluoride in the deoxidizer and use of fluoride in the form of sodium fluoride in the conversion coating solution utilized in the process for corrosion resistance coating of aluminum alloy.

Chromate conversion coatings on aluminum surfaces is disclosed in U.S. Pat. No. 4,531,978 issued to Otrhalek et al. on Jul. 30, 1985 wherein the fluoride sources include hydrofluoric acid, sodium fluoride, ammonium bifluoride and others (lines 34-42 of col. 2).

U.S. Pat. No. 4,036,667 issued to Simon on Jul. 19, 1977 relates to chromate conversion coating process for aluminum and its alloys and wherein the source for fluoride ion includes sodium fluoride or potassium fluoride.

Newell et al. disclose in U.S. Pat. No. 3,752,707 issued on Aug. 14, 1973, a method for corrosion resistance coating on aluminum alloys using solution containing chromium compound, rare earth salt and inorganic fluoride (from NaF, HF, etc.).

U.S. Pat. No. 4,146,410 issued to Reinhold on Mar. 27, 1979 teaches non-ferricyanide chromate conversion coating for aluminum surfaces with enhanced anti-corrosion and improved paint bonding characteristics.

A further impediment to the formation of continuous coatings that must withstand corrosion occurs when it becomes necessary to apply the conversion coating by brush in the case where it is not possible to apply the chromate coatings by the usual immersion techniques. This will occur, for example on a missile motor when a bearing ring or other high-strength aluminum alloy attachment is connected permanently to the motor body, and any contact of the chromate solution with the body will cause deleterious chemical interactions. Thus, the use of a brush or other hand applicators is mandated for this as well as brush-on formation of coatings that must in addition be repaired because of physical damage to the coating.

OBJECTIVES OF THE INVENTION

An objective of the present invention is to improve the chemical resistance of aluminum alloy parts used in missile systems.

A further objective of the present invention is to improve significantly the salt spray corrosion resistance of heat treated aluminum alloys upon which anti-corrosion chromate conversion coatings are deposited.

A still further object of the present invention is to improve coating uniformity of anti-corrosion chromate conversion coated aluminum alloys when applied by the brush applicator method.

SUMMARY OF THE INVENTION

These and other objects have been demonstrated by the present invention wherein the solution processing methods are modified and by pre-treating the aluminum alloy part surface with the same or similar solution in a brush applicator method.

DESCRIPTION OF THE PREFERRED EMBODIMENTS

This invention is a means to markedly improve the uniformity and the salt-spray pitting corrosion resistance of chromate conversion coatings on high strength heat-treated, overaged aluminum alloys. This is achieved by the relatively simple means of chemical additions to the preparative solutions which involves modifying the precoating and conversion coating solutions. Improvements can also be achieved by modification of the metal surface preliminary to deposition of the coatings.

This invention finds particular application in improving the corrosion resistance of heat treated 7000 series aluminum alloys (e.g. 7075-T73).

The chromate conversion coatings used in this invention include both standard (non-accelerated) and ferricyanide-catalyzed (accelerated) deposition formulations. It has been found that Alodine 600, manufactured by Henkel Parker Amchem Products, Inc., Ambler, Pa., is an especially suitable non-accelerated chromate conversion coating. Alodine 600 is comprised of the following compounds: 45–50% sodium fluoroborate, plus 15–20% potassium fluorozirconate, plus 35–40% chromic acid. The process and composition of the chromate conversion coating was known prior to this invention and is shown in U.S. Pat. Nos. 2,851,385 issued to Spruance and James on Sep. 9, 1958, 2,276,353 and 2,507,956, and disclosures of which are hereby incorporated by reference.

Alkaline solutions in all but the lowest concentrations rapidly attack aluminum and its alloys. Therefore, one method of mitigating the salt spray corrosion of Alodine 600 coated aluminum is to prevent or minimize the postulated alkaline attack on the $MgZn_2$ and $MgZn_2Al_2$ precipitates on the surface of the aluminum during the metal clearing pretreatment steps. Alkaline attack results in asperities and holes. Avoidance of this would lessen the need for difficult precision coating steps. Alkaline attack can be minimized by application of a low-activity metal cleaning solution (following the vapor degassing step) which is less chemically active than current alkaline soak cleaners.

A second method of mitigating corrosion involves choosing a deoxidizer or combination of deoxidizers which are more chemically selective such that attack on the metallurgical particulates will be more controlled. Modified time and temperature conditions for the deoxidizing process using current systems will also minimize these reactions. Many aluminum alloys are highly resistant to nitric acid in concentrations of 80–99%. Therefore, especially suitable as a selective deoxidizer is nitric acid in a separate bath to deoxidize and remove by dissolution the microcopper-containing particles from the alloy surface before standard deoxidizing.

Another method is modification (reduction) of the film formation rate to maximize the uniformity of coating deposition at the asperities as well as at the grain boundaries. Grain boundary corrosion is evidenced by the formation of microcanyons and valleys, and has been observed when deoxidizer and non-accelerated chromate conversion coating solutions are allowed to remain in extended contact with alloy surfaces. Experimentation with 7075-T73 panels and Alodine 600 has indicated that a 12–18 minute contact time resulted in poorer salt spray resistance than 4–6 minute immersions, in which the coating weights were essentially the same, 48–52 $mg/ft^2$.

Coating formation rate is also dependent on the rate of stirring/mixing of the Alodine 600 solution in contract with the substrate alloy. Immersion of parts in Alodine 600 without mixing sometimes will improve coating uniformity. Alloy panels unequivocally passed the salt spray test after alkaline soak and standard deoxidizer pretreatments. Other panels which were similarly pretreated and coated with rapid stirring, failed the salt spray test.

A fourth method of improving salt spray corrosion resistance is metallurgical surface modification whereby the alloy surface is burnished or scoured to close or smear over the precipitates, micropits and copper particles, thereby exposing a uniform aluminum metal surface to the treatment solutions. However, the mechanical technique involves extended hand labor and pressure and the use of burnishing materials; it is eventually successful in reducing pitting corrosion.

The difficulty in the mechanical technique was negated by utilizing the original chromate formulation as a lubricant and acidic cleaner during the mechanical processing. It was discovered that, as a result, the spray corrosion resistance was improved significantly when the chromate conversion coating was subsequently applied by brush. However, it was also discovered that the brush-on chromate solutions were not as successful if the solutions were applied as-is i.e. the same acidity as the immersion coatings. In the latter instance, the coatings will be transparent or colorless, and in many instances will not pass the salt spray test. A further discovery indicated that a lower pH (higher acid content) of pH 0.9 to 1.5 was needed to form the golden-yellow or gray iridescent colored coatings that are typical of the colors formed on well-coated 7000 series alloys than the typical pH of 1.6 to 2.0 utilized in the immersion method. When the lower pH chromate solution was applied by brush, e.g., via abrasive pad, as the metal cleaner preliminary to brush application of the chromate coating, the significant extension in corrosion resistance occurred. From a one to two week period of corrosion resistance, the improved coating application methodology resulted in a three to four week salt spray resistance, an improvement of at least 100%, or up to 400%, depending on the orginal control corrosion resistance. Further to this accomplishment, it was found that the new method resulted in an extremely thin colorless chromate coating that was not removed during the water washing process, and that the technique unexpectedly yielded the significant improvement noted. The presence of the preliminary coating was detected by Auger surface spectroscopy following the observation of the improved corrosion resistance. It should be noted that it is required to utilize the newly discovered brush-on application formulation following the cleaning step described above to give the stated level of improvement.

Amchem Toner 22 or Alodine 22 Toner, also sold by Henkel Parker Amchem Products Inc., has been found useful in mixing the formulations of the invention. Toner 22 is 5 to 10% sodium hydroxide, 10 to 15% sodium nitrate, and 1% sodium chloride in a water solution.

A preferred embodiment of the formulation for abrasive cleaning and brush-on applications of an iridescent gray conversion coating is: 45 grams of Alodine 600 powder dissolved in 2 liters of deionized water to form a solution, plus 40 cubic centimeters of Toner 22 dissolved in said solution, plus 12 cubic centimeters concentrated nitric acid added to said solution and stirred ten minutes. The final pH will be 0.95 to 1.15.

Another embodiment of the formulation for abrasion cleaning and brush-on application of a golden-yellow iridescent conversion coating is: 45 grams of Alodine 600 powder dissolved in 2 liters of deionized water to form a solution, plus 40 cubic centimeters of Toner 22 dissolved in said solution, plus 8 cubic centimeters concentrated nitric acid added to said solution and stirred ten minutes. The final pH will be 1.4 to 1.5.

A final method involves processing modification whose objective is to minimize the spray corrosion susceptibility of Alodine 600 coated alloys, specifically the 7075-T73 alloy. Nevertheless, this alloy has been coated successfully with Alodine 1200S, which is also manufactured by Amchem Products, Inc. Alodine 1200S is comprised of the following compounds: 54% by weight chromic acid, 22% by weight potassium fluoroborate, 2% by weight potassium fluorozirconate, 6% by weight sodium fluoride, and 16% by weight potassium ferricyanide. This formulation and its method of manufacture is well known in the art and is contained in U.S. Pat. Nos. 2,796,370 and 2,796,371 issued to Ostrander et al. on Jun. 18, 1957, the disclosures of which are hereby incorporated by reference.

Alodine 1200S in its solid form contains almost twice the $CrO_3$ content as Alodine 600. Additionally, 1200S also contains simple (uncomplexed) fluorides which dissolve and dissociate readily to produce a relatively large amount of free HF in solution, compared with that produced by Alodine 600 which contains complex fluorides. Since HF is a critical component in the conversion coating mechanism, the addition of free HF, NaF or $NH_4HF_2$ will improve coating uniformity and therefore salt spray resistance. A suitable additive is manufactured by Amchem Products, Inc., under the tradename Amchem Toner No. 1.

This invention is not limited to the preferred embodiment and alternatives heretofore described, to which variations and improvements may be made, without departing from the scope of protection of the present patent and true spirit of the invention, the characteristics of which are summarized in the following claims.

What is claimed is:

1. A method for producing a conversion coating used for salt spray corrosion protection of an aluminum surface, particularly for 7000 series aluminum, comprising the steps of:

abrasion cleaning the aluminum surface with cleaning formulation of pH 0.9 to 1.5 substantially consisting of 45 grams of conversion powder dissolved in 2 liters of deionized water to form a conversion solution, said conversion powder comprising 45 to 50% sodium fluoroborate, 15 to 20% potassium fluorozirconate, and 35 to 40% chromic acid, and then brush coating the surface with a coating formulation which is the same as said cleaning formulation.

2. The method of claim 1 wherein said coating formulation is said cleaning formulation to which has been added 40 cubic centimeters of toner dissolved in said solution, said toner comprising 5 to 10% sodium hydroxide, 10 to 15% sodium nitrate and 1% sodium chloride in a water solution, and then 8 to 12 cubic centimeters concentrated nitric acid.

3. The method of claim 2 for producing a golden-yellow iridescent conversion coating used for salt spray corrosion protection of an aluminum surface, particularly for 7000 series aluminum, wherein the amount of concentrated nitric acid added to the solution is approximately 8 cubic centimeters.

4. The method of claim 3 wherein said cleaning formulation is also modified by adding 40 cubic centimeters of toner dissolved in said solution, said toner comprising 5 to 10% sodium hydroxide, 10 to 15% sodium nitrate and 1% sodium chloride in a water solution, and then adding approximately 8 cubic centimeters of concentrated nitric acid to said solution.

5. The method of claim 2 for producing a gray iridescent conversion coating used for salt spray corrosion protection of an aluminum surface, particularly for 7000 series aluminum, wherein the amount of concentrated nitric acid added to the solution is approximately 12 cubic centimeters.

6. The method of claim 5 wherein said cleaning formulation is also modified by adding 40 cubic centimeters of toner dissolved in said solution, said toner comprising 5 to 10% sodium hydroxide, 10 to 15% sodium nitrate and 1% sodium chloride in a water solution, and then adding approximately 12 cubic centimeters of concentrated nitric acid to said solution.

7. The method of claim 2 wherein said step of abrasion cleaning is performed with an abrasive pad of alumina-filled Nylon fibers that have been saturated with said cleaning formulation.

8. The method of claim 7 including a wash step after said abrasion cleaning step and before said coating step, wherein said wash step is used after 3 to five minutes of abrasion cleaning, and said wash step comprises at least three times washing off salts and reacted aluminum particles using deionized water in a new cheesecloth pad until said new cheesecloth pad remains clean after wiping.

* * * * *

UNITED STATES PATENT AND TRADEMARK OFFICE

CERTIFICATE OF CORRECTION

PATENT NO. : 5,123,978

DATED : June 23, 1992

INVENTOR(S) : Lionel J. Bailin and Wash Kostinko

It is certified that error appears in the above-identified patent and that said Letters Patent is hereby corrected as shown below:

On the title page, item (19) and (75):

Please correct inventors name from "Balin" to --Bailin--

Signed and Sealed this

Seventeenth Day of August, 1993

Bruce Lehman

*Attest:*

BRUCE LEHMAN

*Attesting Officer*

*Commissioner of Patents and Trademarks*